United States Patent [19]

Kemper et al.

[11] 4,098,212

[45] Jul. 4, 1978

[54] TANKER LOADING TERMINAL

[75] Inventors: Wilhelmus Kemper, The Hague; Gerard Kruisman, Waarder; Hendrikus S. Rutten, Voorburg, all of Netherlands

[73] Assignee: Shell Oil Company, Houston, Tex.

[21] Appl. No.: 769,627

[22] Filed: Feb. 17, 1977

[51] Int. Cl.[2] ..... B63B 21/00

[52] U.S. Cl. ..... 114/230; 9/8 P

[58] Field of Search ..... 114/230, 264, 265; 9/8 P

[56] References Cited

U.S. PATENT DOCUMENTS

| | | | |
|---|---|---|---|
| 2,882,536 | 4/1959 | Jordan | 9/8 P |
| 3,404,654 | 10/1968 | Kohring | 114/230 |
| 3,440,671 | 4/1969 | Smulders | 114/230 |
| 3,522,787 | 8/1970 | Tam | 114/230 |
| 3,541,662 | 11/1970 | Harlow | 114/230 |
| 3,908,576 | 9/1975 | Van Der Gaag | 9/8 P |

*Primary Examiner*—Stephen G. Kunin
*Assistant Examiner*—Stuart M. Goldstein

[57] ABSTRACT

An offshore mooring system for tankers having a fixed vertical column anchored to the ocean floor that is provided with a rotating arm having one end connected to the column by a centralizing structure formed by a weight-actuated gravity spring system.

7 Claims, 5 Drawing Figures

FIG. 3
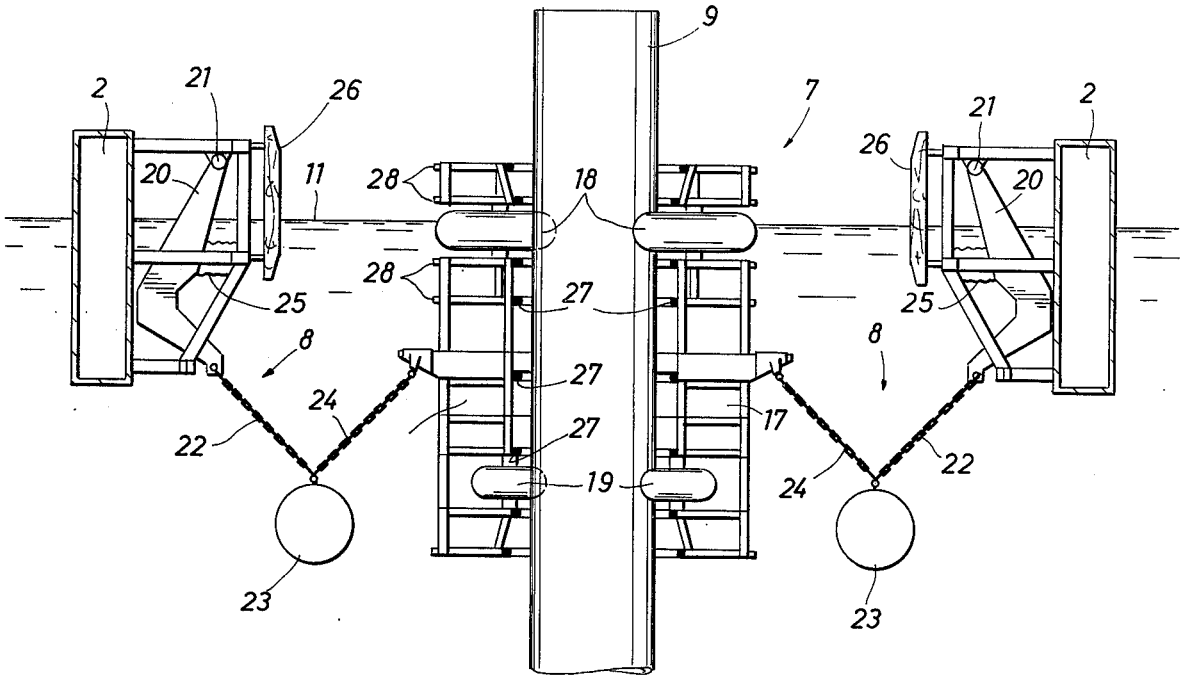
FIG. 4
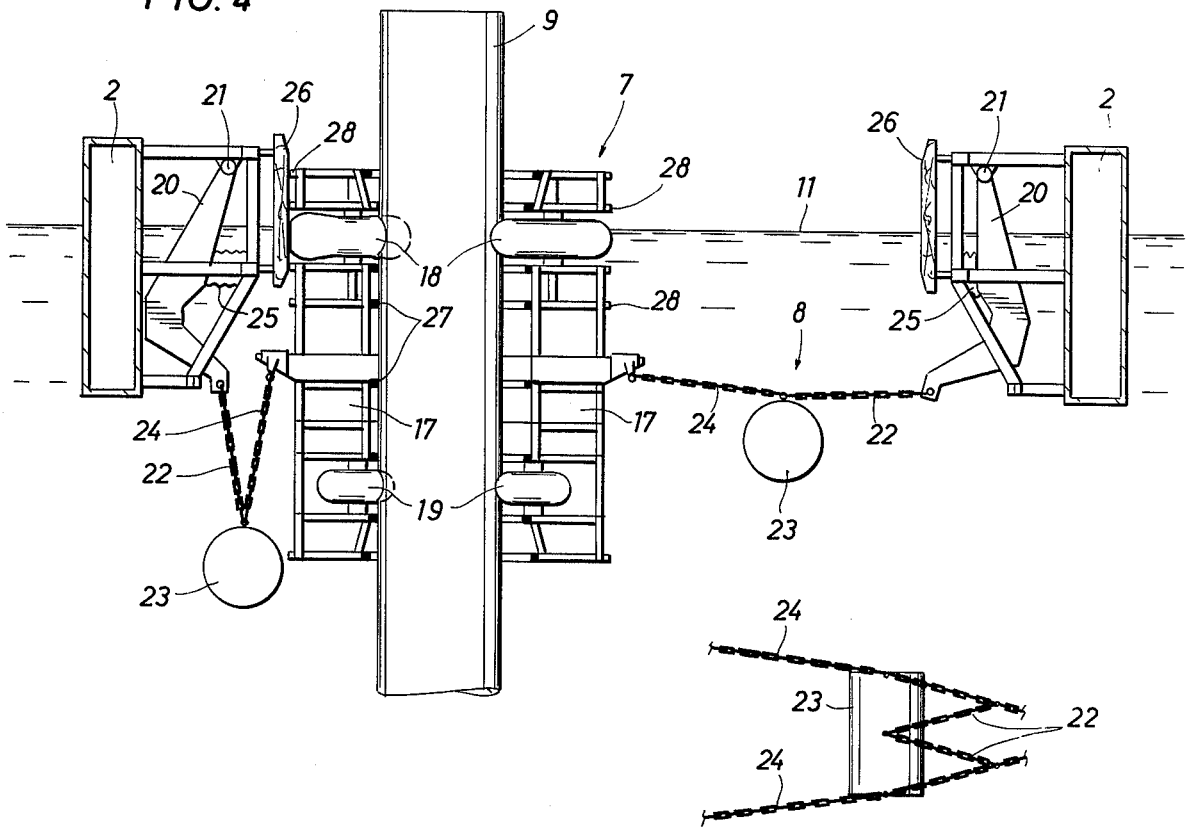
FIG. 5

TANKER LOADING TERMINAL

BACKGROUND OF THE INVENTION

The present invention falls in the class of mooring systems taught, for example, in U.S. Pat. No. 3,522,787 in which the rotatable member is centrally positioned about a mooring column by a spoke-like arrangement of nylon line.

SUMMARY OF THE INVENTION

The invention relates to a mooring system, in particular for (un)loading a tanker, which system is of the known kind comprising a floating mooring arm, which is adapted to rotate freely around a structure, said structure being secured to the water bottom. In normal use a tanker is moored alongside the floating mooring arm of such a mooring system for loading or unloading.

The invention relates in particular to a new simple and robust construction for connecting the floating mooring arm to the vertical structure.

The mooring system according to the invention comprises a structure secured to the water bottom, an annular element so arranged that it is rotatable around the structure, an annular member arranged around and connected to the annular element, a floating mooring arm secured to, or forming a unit with, the annular member, wherein the annular member is connected to the annular element by means of a gravity spring system.

In a suitable embodiment of the mooring system according to the invention, the gravity spring system comprises a set of weights, each weight being suspended between the annular member and the annular element by means of a number of elongated suspension elements.

Preferably, each elongated suspension element is connected to the annular member and/or to the annular element via a lever arm, said lever arm being rotatable around a horizontal axis and acting against an elastic element.

The main purpose of the last-mentioned embodiment of the invention is that the elastic elements will reduce the stiffness of the gravity spring system at nearly fully stretched positions.

BRIEF DESCRIPTION OF THE DRAWING

The invention will be further explained with reference to the drawings, wherein:

FIG. 3 shows schematically a vertical cross-section of the connection between the floating mooring arm and the vertical structure, wherein the mooring arm is in the neutral position relative to the vertical structure;

FIG. 4 shows schematically the connection according to FIG. 3, wherein the mooring arm is in eccentric position relative to the vertical structure;

FIG. 5 shows schematically a top plan view of one of the weights together with the elongated suspension elements.

DESCRIPTION OF A PREFERRED EMBODIMENT

Figure 1:
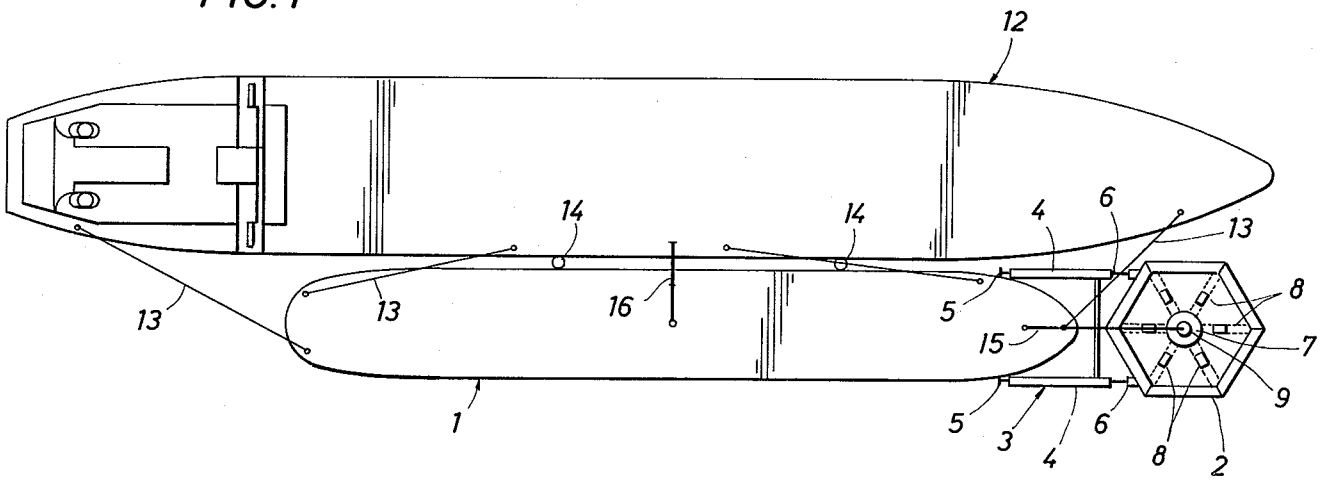
FIG. 1 shows schematically a top plan view of an embodiment of a mooring system according to the invention.
Figure 2:
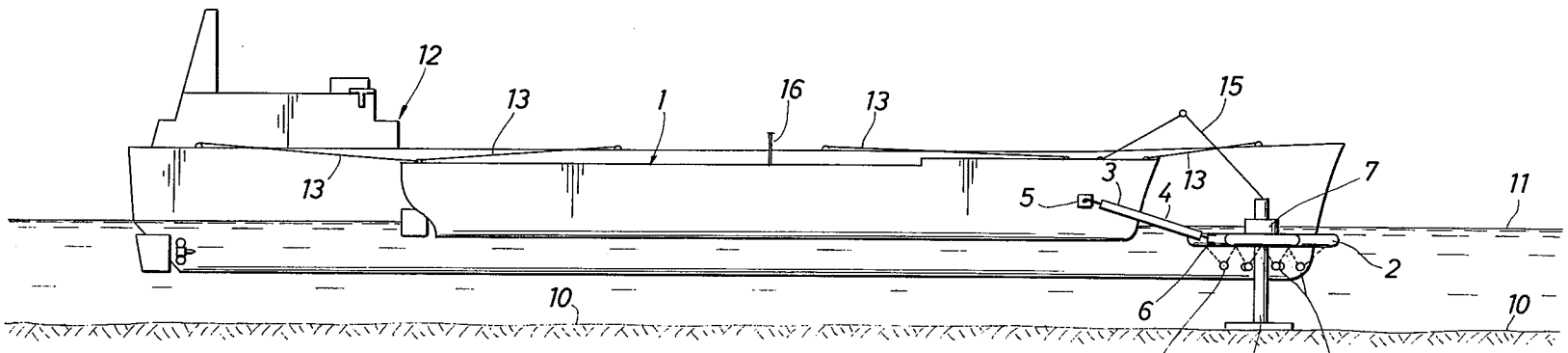
FIG. 2 shows schematically a side view of the embodiment according to FIG. 1.

In FIGS. 1 and 2, the floating mooring arm, which is in this embodiment of the invention a stationary tanker 1, is secured to a buoyant annular member 2 by means of a frame 3. The frame 3 is substantially U-shaped and comprises two arms 4 which are rigidly interconnected. The arms 4 are connected to the floating mooring arm 1 by means of hinges 5 having horizontal hinge axes. The arms 4 are furthermore connected to the annular member at 6. The annular member 2 is arranged around and connected to an annular element 7 by means of a gravity spring system which is generally indicated by the reference numeral 8, and which will be discussed in detail with reference to FIGS. 3 through 5.

The annular element 7 is preferably buoyant and is rotatably arranged around a vertical structure 9. The vertical structure 9 has for example the form of a pile and is secured to the water bottom 10 and extends preferably above the water surface 11.

In FIGS. 1 and 2, a tanker 12 is moored alongside the mooring arm 1 by means of mooring cables 13, conventional fenders 14 being present between the mooring arm or stationary tanker 1 and tanker 12. A loading arm 15 serves to connect the stationary tanker 1 to a fluid discharge or supply conduit (not shown) on or in the vertical structure 9. A loading arm or hose 16 serves to create a fluid communication between the stationary tanker 1 and the tanker 12.

The gravity spring system 8 will now be described more in detail with reference to FIGS. 3, 4 and 5.

Around the vertical structure 9 the annular element 7 is arranged. The annular element 7 is provided with buoyancy chambers 17 and with a number of fender wheels 18 and 19 (for example having outside diameters of 114 inches and 78 inches, respectively). The fender wheels 18 and 19 are adapted to rotate around vertical axes as shown. Each fender wheel 18,19 respectively, is in contact with the outer surface of the vertical structure 9 in such a manner that when the annular element 7 rotates around the structure 9, the fender wheels 18 and 19 will roll along the outer surface of the structure 9. This construction does not prevent the annular element 7 from sliding in a vertical direction relative to the structure 9.

The annular member 2 which surrounds the annular element 7 is provided with a number of lever arms 20. Each arm 20 is secured to the annular member 2 by means of a corresponding hinge 21 having a horizontal axis. Each lever arm 20 is adapted to act against an elastic element 25, which is made of a suitable rubber or plastic. Chains 22 are secured to the free ends of the lever arms 20. The other ends of the chains 22 are secured to weights 23. Each weight 23 is, for example, a concrete cylinder surrounded by a hollow cast iron or steel cylinder. Furthermore, chains 24 are secured to the annular element 7. The other ends of the said chains 24 are secured to the weights 23. As shown in FIG. 1, the number of weights 23 suspended between the annular member 2 and the annular element 7 is six. A wooden fender ring 26 is secured to the annular member 2 in the manner as shown in FIGS. 3 and 4.

As clearly shown in the figures, the floating mooring arm 1 is connected via the annular member 2 to the annular element 7 via the gravity spring system 8. The gravity spring system 8, when pushed out of the neutral position, absorbs energy by accumulating it in weights 23 which are being lifted. This gravity spring system must provide enough room to the floating mooring arm 1 to move according to the motions of the mooring arm 1 together with a tanker moored to it as a result of the waves, wind or current or according to the motions of the mooring arm 1 as a result of the waves, wind or current when no tanker is moored to it. Furthermore, the gravity spring system 8 has to be strong enough to withstand the forces caused by wind, current and waves.

A suitable fender system is present to take up extreme forces. The rubber fender wheels 18 and 19 are adapted to guide motions of the annular element 7 around the structure 9. The upper fender wheels 18 act as a fender work against the wooden fender ring 26 in case of complete stretching of the gravity spring system 8, which situation is shown in FIG. 4. Any additional loads will be transferred by solid rubber fender rings 27, respectively 28, arranged respectively on the inner and the outer faces of the annular element 7. To decrease the stiffness of the gravity spring system at nearly fully stretched positions the non-linear gravity spring arrangement 8 is connected in series via the lever arms 20 to the elastic elements or springs 25.

The vertical structure 9 is preferably a hollow steel tube, which is secured to the water bottom 10 in a suitable manner, for example by means of a space frame (not shown) which is, for example, anchored to the water bottom 10 by means of a suitable number of piles (not shown) in a manner well known to the art.

In the embodiment according to FIGS. 1 and 2, the floating mooring arm 1 has the form of a stationary tanker. Instead, it is possible to use a mooring arm having the form of a rigid space frame built with steel tubes and preferably provided with a number of flotation tanks, to give the rigid space frame sufficient buoyancy.

The operation of the mooring system according to the invention is as follows.

The floating mooring arm 1 is so secured to the structure 9 that the mooring arm is free to rotate around the structure 9. In this manner the mooring arm 1 will offer minimum resistance to waves, winds and currents. When a tanker has to be unloaded or loaded, the tanker 12 is moored alongside the mooring arm 1 by means of mooring lines 13. Then a loading arm 16 is connected to the manifold of the tanker 12. The loading arm 16 is in fluid communication with a pipeline (not shown) on the mooring arm 1 which communicates with a loading arm 15. The loading arm 15 communicates via a fluid swivel with a conduit (not shown) on or within the structure 9. The last-mentioned conduit is in communication with a pipeline on or in the sea bottom 10 leading for example to shore.

When it is desired to load the tanker 12, fluid, for example crude oil, oil products or liquefied gas, is supplied via the pipeline in or on the sea bottom, the conduit in or on the structure 9, the loading arm 15, the pipeline on the mooring arm 1 and the loading arm 16 to the tanker 12. When it is desired to unload the tanker 12, the fluid is pumped through the said various conduits, pipelines and loading arms in the opposite direction.

When the floating mooring arm is a stationary tanker as shown in FIGS. 1 and 2, it is possible to store the fluid temporarily in the tanks of the stationary tanker 1.

In the embodiment as shown in the drawings, the annular member 2 is secured to the mooring arm 1 by means of the frame 3. Instead, it is possible to secure the mooring arm 1 to the annular member 2 in a rigid manner, for example so that the annular member 2 forms a unit with the mooring arm 1.

In the embodiment as shown in the drawings the elongated suspension elements for the weights 23 are chains 22 and 24. Instead it is possible to use cables or metal bars. When metal bars are used as elongated suspension elements, it is necessary to secure the ends of said bars in a hingeable manner respectively to the annular element 7, the annular member 2 and to the weights 23. In the embodiment as shown in the drawings the lever arms 20 are arranged on the annular member 2. If desired, it is possible to arrange such lever arms on the floating annular element 7 or on the annular member 2 and on the floating annular element 7.

In the embodiment as shown in the drawings six weights 23 are used. It is remarked that any suitable number of weights can be used if desired.

We claim as our invention:

1. A mooring system, in particular for (un)loading a tanker, comprising a structure secured to the water bottom and extending vertically to a point above the water line, an annular element rotatably mounted on said structure substantially at the water line thereof, an annular member concentrically mounted outwardly of and operatively connected to the annular element, a floating mooring arm operatively secured to the annular member, a gravity-actuated spring system connecting the annular member to the annular element, said gravity-actuated spring system comprising a set of weights, each weight being suspended between the annular member and the annular element by means of elongated suspension means, a plurality of elastic means carried on said annular member, each of said elongated suspension means being operatively connected between the annular element and an elastic means on the annular member, each of said elastic means being provided with a lever arm operatively connected thereto, and horizontal pin means engaging one end of said lever arm and mounted on said annular member, the other end of said lever arm being connected to the end of said elongated suspension means.

2. The mooring system as claimed in claim 1, wherein the elastic element is made of rubber.

3. The mooring system as claimed in claim 1, wherein the annular member is buoyant.

4. The mooring system as claimed in claim 1, wherein the floating mooring arm is a tanker.

5. The mooring system as claimed in claim 1, including a frame for securing said floating mooring arm to the annular member, and hinge means having horizontal axes, said hinge means being connected to the frame and the floating mooring arm.

6. The mooring system as claimed in claim 1, including buoyant means on said annular element, said element being slidable in a vertical direction relative to the structure.

7. A mooring system, in particular for (un)loading a tanker, comprising a structure secured to the bottom of a body of water and extending vertically to a point above the water line, first annular means rotatably mounted on said structure substantially at the water line thereof, second annular means concentrically mounted outwardly of and operatively connected to the first annular means, a floating mooring arm operatively secured to the second annular means and extending horizontally therefrom, a gravity-actuated spring system connecting and extending between said first and second annular means, said gravity-actuated spring system comprising a set of weights, each weight being suspended between the first and second annular means by elongated suspension means, and a plurality of elastic means selectively carried on one of said annular means, one end of each of said elongated suspension means being connected to one of said elastic means on one of said annular means and the other end of said suspension means being connected to the other of said annular means.

* * * * *